US006617942B1

(12) United States Patent
Jones et al.

(10) Patent No.: US 6,617,942 B1
(45) Date of Patent: Sep. 9, 2003

(54) HYBRID MULTI-POLE GAIN ZERO FILTER ELEMENT

(75) Inventors: Lynette M. Jones, Randallstown, MD (US); Patrick J. Knowles, Severn, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/075,346

(22) Filed: Feb. 15, 2002

(51) Int. Cl.[7] ..... H01P 1/20; H01P 1/203

(52) U.S. Cl. ..... 333/202; 333/204

(58) Field of Search ..... 333/116, 109, 333/128, 161, 156, 202, 204, 205, 219

(56) References Cited

U.S. PATENT DOCUMENTS

| | | | | |
|---|---|---|---|---|
| 3,772,616 A | * | 11/1973 | Imoto | 333/128 |
| 4,127,831 A | * | 11/1978 | Riblet | 333/113 |
| 4,205,282 A | | 5/1980 | Gipprich | 333/161 |
| 4,305,043 A | * | 12/1981 | Ho et al. | 330/53 |
| 4,721,929 A | | 1/1988 | Schnetzer | 333/127 |
| 5,150,084 A | | 9/1992 | Asa et al. | 333/128 |
| 5,489,880 A | | 2/1996 | Swarup | 333/128 |
| 5,497,131 A | * | 3/1996 | Takahashi et al. | 333/204 |
| 5,563,558 A | | 10/1996 | Mohwinkel et al. | 333/127 |
| 5,683,434 A | | 11/1997 | Archer | 607/36 |
| 6,121,854 A | | 9/2000 | Griffith et al. | 333/128 |
| 6,157,274 A | * | 12/2000 | Tada et al. | 333/204 |
| 2002/0158704 A1 | * | 10/2002 | Ye | 333/204 |

FOREIGN PATENT DOCUMENTS

| | | | | |
|---|---|---|---|---|
| JP | 59190701 A | * | 10/1984 | H01P/1/18 |

* cited by examiner

*Primary Examiner*—Seungsook Ham
(74) *Attorney, Agent, or Firm*—Birch, Stewart, Kolasch & Birch, LLP

(57) ABSTRACT

A hybrid filter element includes an impedance transformer and a phase cancellation loop having a first portion and a second portion is disclosed. The first and second portions are designed to provide a phase difference between the two portions of about 180° at a mid-band frequency. The first portion forms part of the impedance transformer and is typically smaller than the second portion. The first and second portions can be designed to have either an equal power split or an unequal power split between the portions.

19 Claims, 7 Drawing Sheets

HYBRID MULTI-POLE GAIN ZERO FILTER ELEMENT

BACKGROUND OF THE INVENTION

1. Field of the Invention

This invention relates generally to filter elements and in particular to compact hybrid multi-pole filter elements that are useful in the design of radio frequency filters.

2. Description of Related Art

Conventional radio frequency filters have been constructed by a variety of different elements. Some of these elements include lumped reactive elements, distributed reactive stubs, and impedance transformers. Each of these conventional elements and techniques has its advantages and disadvantages.

For example, the lumped elements usually provide the smallest foot print. However, lumped elements also have the highest insertion loss and are suitable only for low power. FIG. 1 is an example of a lumped element model of a low-pass filter (LPF). The reactance of the inductors is $X_L=j\omega l$ and the capacitor reactance is $X_C=1/j\omega C$. These equations are well known to those skilled in the art. At low frequencies $X_L=0\Omega$ and $X_C=\infty\Omega$, these characteristics allow low frequency signals to pass through the inductors between P1 and P2. Alternatively, at high frequencies $X_L=\infty\Omega$ and $X_C=0\Omega$, these characteristics prevent high frequency signals from passing through the circuit between P1 and P2. FIG. 2 is a graph of the reflection coefficient ($\Gamma$) of a capacitor and inductor.

Alternatively, reactive stubs have low insertion loss, but can be physically large. Also, reactive stubs tend to have a narrow bandwidth, which can make them unsuitable for wideband applications. FIG. 3 is an example of a LPF using $\lambda/4$ wave open-end stubs. A LPF composed of distributed elements is possible by having opened-ended stubs (i.e., reactive stub) of $\lambda/4$ wave length at the frequency that is rejected. This causes the stub to appear as an open circuit above and below a rejection frequency. At the rejection frequency, the stub appears as a short circuit thereby allowing no signal flow. The stubs are also spaced 90° electrically apart at the pass band of a fundamental frequency for matching purposes. This filter element produces nulls that are deep. However, the tradeoff is a small bandwidth of 2%, as shown in FIG. 4. Therefore, numerous stubs are required to obtain a wide bandwidth. Although a very good response can be obtained, the numerous stubs produce an extremely long filter element. Thus, these elements are not suitable for compact circuits.

FIG. 5 is an example of a LPF using impedance transformers. A distributed impedance transformer LPF typically has a wide bandwidth. However, the nulls of the filter are very small. The filter design comprises transforming from a high to low impedance until the desired bandwidth is reached. Because of the large bandwidth of the transformers, few transformers are needed. In addition to the very small nulls produced by this design, the roll off of the circuit, as shown in FIG. 6, is so gradual that it can interfere with the pass band. Those skilled in the art will appreciate that the low nulls and gradual roll off characteristics of the transformer design make it unsuitable for many applications.

SUMMARY OF THE INVENTION

Accordingly, it is an object of the present invention to provide an improvement of filter elements and filter designs.

It is yet another object of the invention to provide a hybrid filter element that has advantageous features of both opened stub and impedance transformer designs.

The foregoing and other objects are achieved by a hybrid filter element comprising an impedance transformer and a phase cancellation loop having a first portion and a second portion. The first and second portions are designed to provide a phase difference between the two portions of about 180° at a mid-band frequency. The first portion can form part of the impedance transformer. Further, the first and second portions can be designed to have either an equal power split or an unequal power split between the portions.

Further scope of the applicability of the present invention will become apparent from the detailed description provided hereinafter. However, it should be understood that the detailed description and specific embodiments, while disclosing the preferred embodiments of the invention, are provided by way of illustration only inasmuch as various changes and modifications coming within the spirit and scope of the invention will become apparent to those skilled in the art from the detailed description which follows.

BRIEF DESCRIPTION OF THE DRAWINGS

The present invention will become more fully understood when the following detailed description is considered in conjunction with the accompanying drawings, which are provided by way of illustration only, and thus are not meant to be limitative of the present invention, and wherein.

DETAILED DESCRIPTION OF THE PREFERRED EMBODIMENTS

The examples described herein are related in terms of Low-Pass Filter (LPF) designs. However, the invention is not limited to these embodiments. Those skilled in the art will appreciate that the elements and design techniques can be used for other circuits and filter designs.

Figure 1:
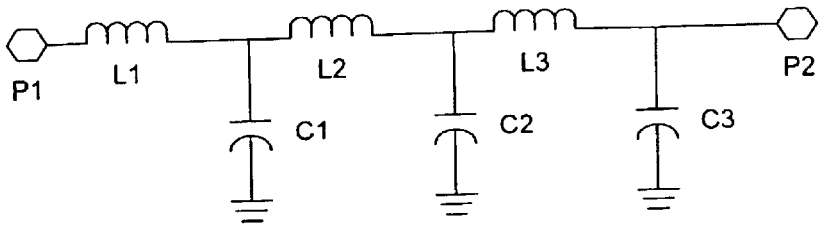
PRIOR ART FIG. 1
FIG. 1 is an example of a lumped element model of a low-pass filter.
Figure 2:
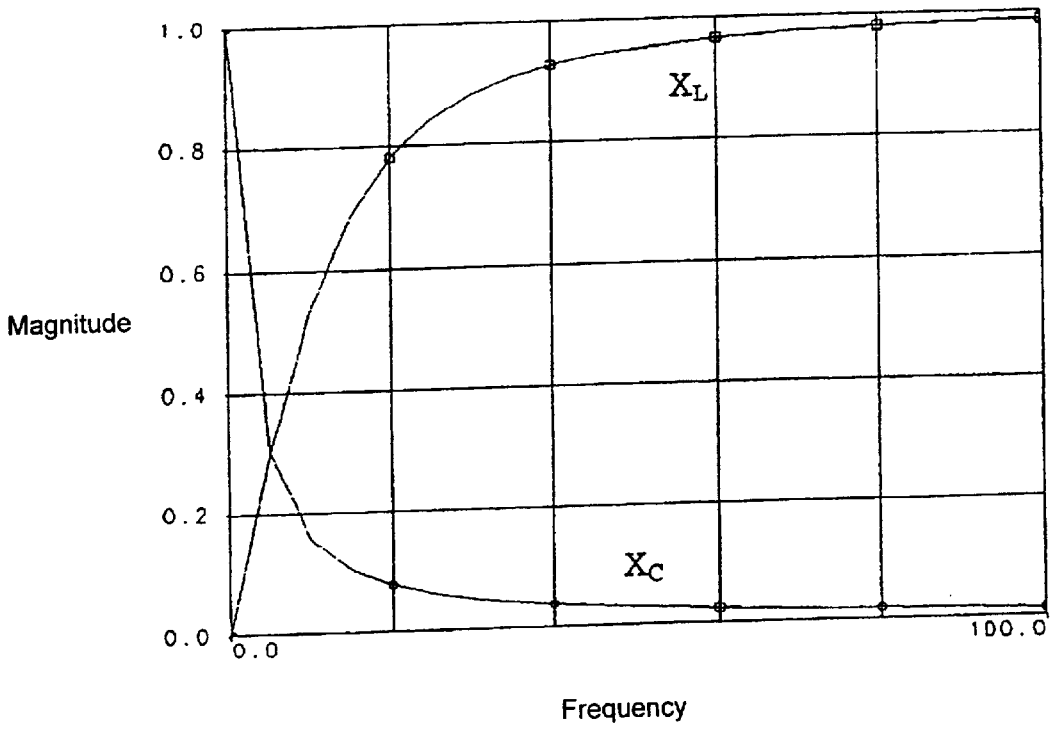
PRIOR ART FIG. 2
FIG. 2 is a graph of the reflection coefficients of a capacitor and an inductor.
Figure 3:
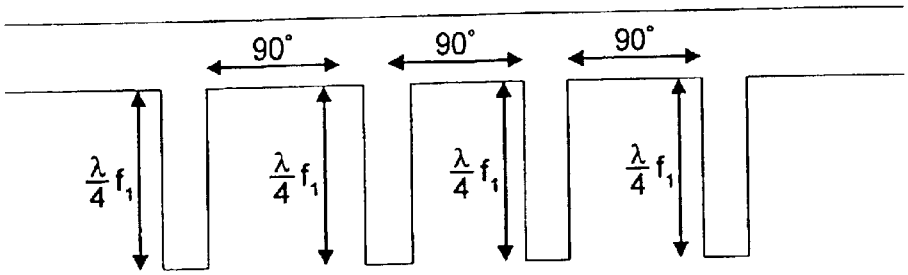
PRIOR ART FIG. 3
FIG. 3 is an example of a LPF using $\lambda/4$ wave open end stubs.
Figure 4:
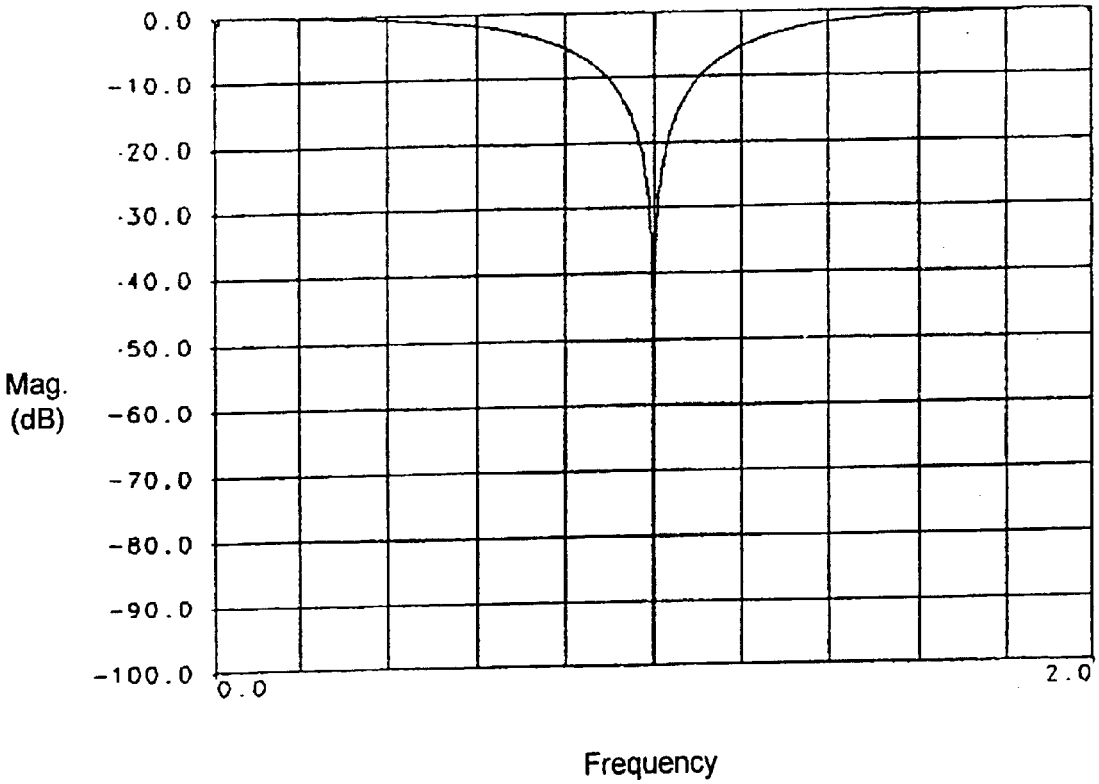
PRIOR ART FIG. 4
FIG. 4 is a graph of the filter response of a LPF using $\lambda/4$ wave open-end stubs.
Figure 5:
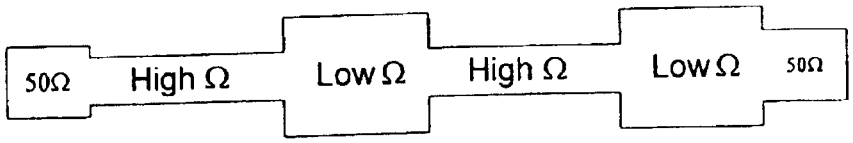
PRIOR ART FIG. 5
FIG. 5 is an illustration of a LPF using an impedance transformer.
Figure 6:
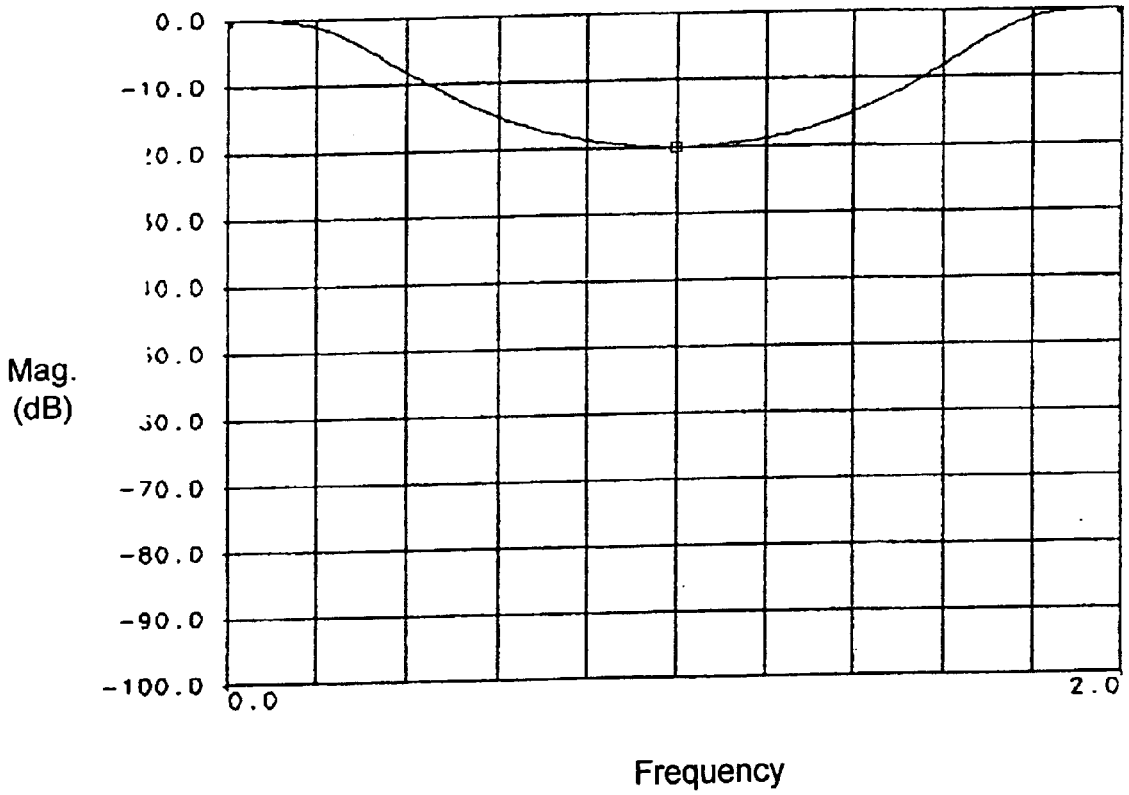
PRIOR ART FIG. 6
FIG. 6 is a graph of the filter response of an impedance transformer design.
Figure 7A:
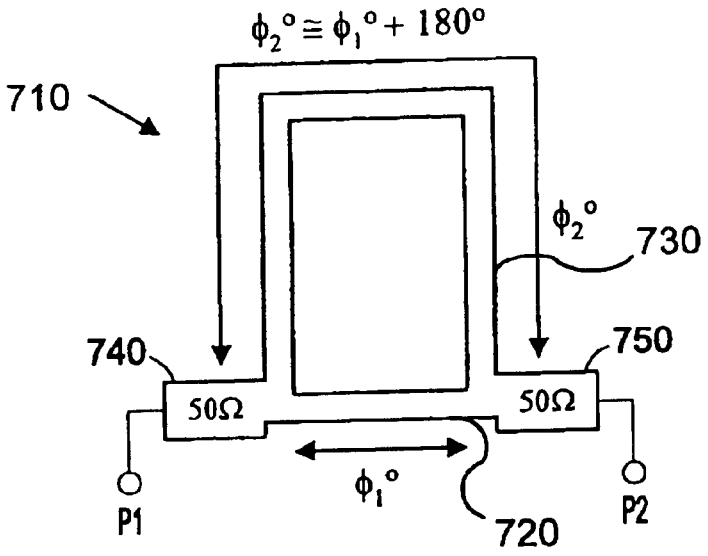
FIG. 7A is illustrative of an exemplary embodiment of the present invention.

Referring to FIG. 7A, an exemplary embodiment of the present invention is shown. A combination of the advantageous characteristics of both the stub and the transformer designs can be achieved by the present invention. A phase cancellation loop 710 provides both a transformer and a stub in the same element. A first portion 720 of the phase cancellation loop 710 produces a phase shift $\phi_1°$. A second portion 730 of the phase cancellation loop 710 produces a phase shift $\phi_2°$. Typically, the first portion 720 is smaller than the second portion 730 and correspondingly produces a smaller phase shift (i.e., $\phi_1° < \phi_2°$). The first and second portion are designed such that the phase difference between the two portions is about 180° (i.e., $\phi_2° \cong \phi_1° + 180°$). At lower frequencies, the signal is in phase causing the element to resemble a stub. At higher frequencies, there are two distinct paths for the signal to travel. A first portion of the signal travels through the first portion 720, while a second portion of the signal travels through the second portion 730. When the signals recombine, the two signals are approximately 180° out of phase. End portions of the impedance transformer 740 and 750 connect the hybrid filter element to external components or additional phase cancellation loops. The hybrid filter element can be designed to have either equal or unequal power splits by appropriate selection of the impedance transformer and cancellation loop elements of the hybrid filter, as will be appreciated by those skilled in the art.

Figure 7B:
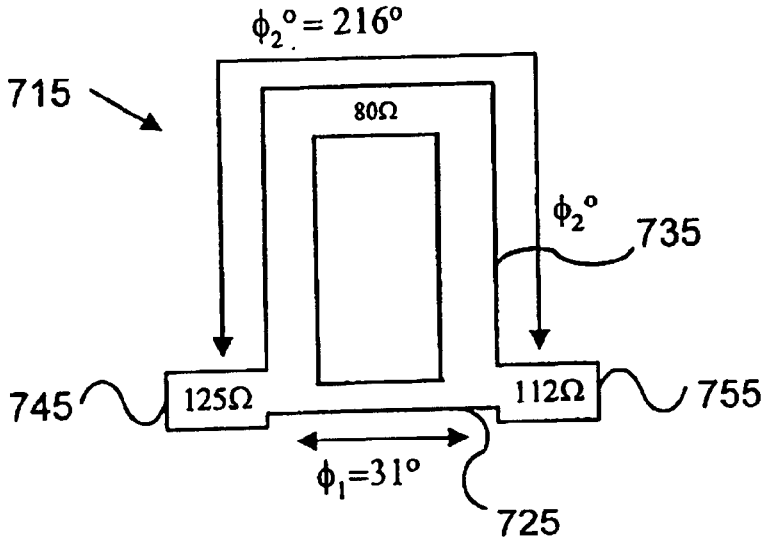
FIG. 7B is illustrative of an exemplary embodiment of the present invention with specific design values.

Referring to FIG. 7B, a specific example of an embodiment of the present invention is shown. A phase cancellation loop 715 has first 725 and second 735 portions. The first portion 725 produces a phase shift of approximately 31°. The second portion 735 produces a phase shift of approximately 216°. Accordingly, the phase difference between the two portions is about 180° (i.e., $\phi_2° - \phi_1° = 216° - 31° = 185° - 180°$). The impedance of second portion 735 is 80Ω and the impedance of the end portions of the impedance transformer 745 and 755 are 125Ω and 112Ω, respectively. Those skilled in the art will appreciated that the invention is not limited to these particular values and that the specific values will depend upon many factors including, the design frequencies, materials, power, and the like.

Figure 8B:
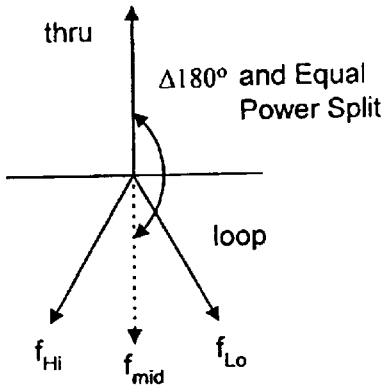
FIGS. 8A–E are illustrative of the response of a filter according to an embodiment of the present invention having an equal power split.
Figure 8A:
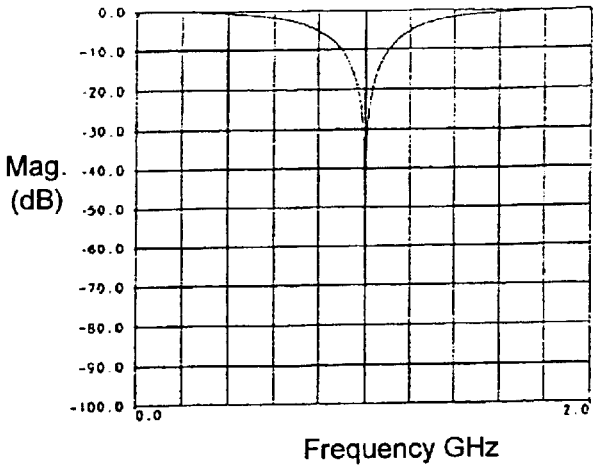
Figure 8C:
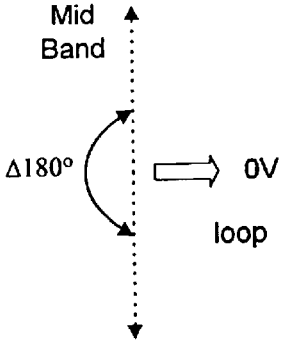
Figure 8D:
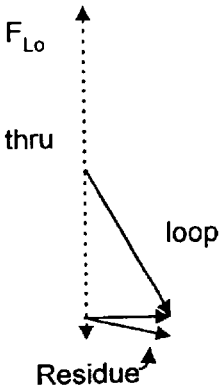
Figure 8E:
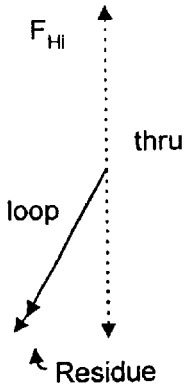

Referring to FIG. 8A–E, a first case is illustrated where the hybrid filter element has a power split that is equal. At a mid-band frequency the phase difference is 180° and there is perfect cancellation of the signal. Therefore, the voltage output approaches zero and a very deep null (zero) is produced, as shown in FIGS. 8A–C. However, off the mid-band frequency at both lower and higher frequencies the signal cancellation is not perfect and there is an error voltage (i.e., residue vector) produced. FIG. 8D shows the residue for frequencies below the mid-band $F_{Lo}$. FIG. 8E shows the residue for frequencies above the mid-band $F_{Hi}$. The bandwidth response for this filter design is approximately two percent.

Figure 9B:
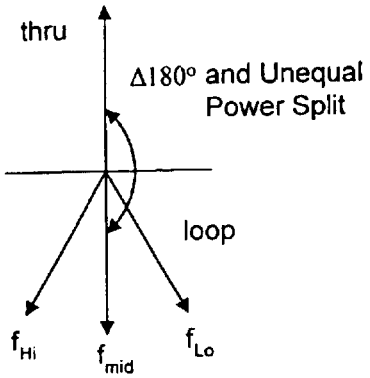
FIGS. 9A–E are illustrative of the response of a filter according to an embodiment of the present invention having an unequal power split.
Figure 9A:
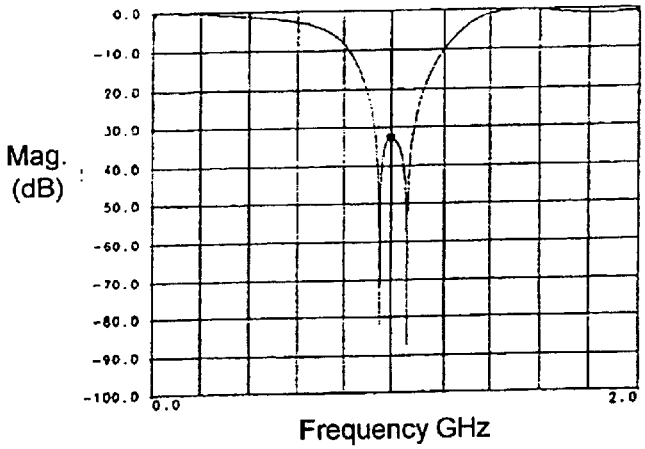
Figure 9C:
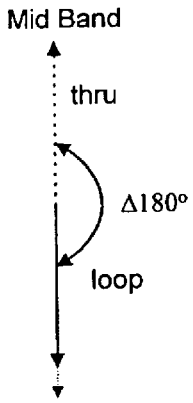
Figure 9D:
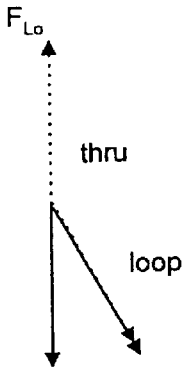
Figure 9E:
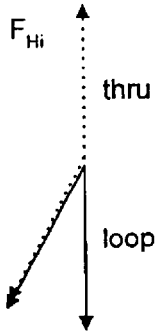

In a second case, as illustrated in FIGS. 9A–E, the hybrid filter element has a power split that is unequal. However, the phase difference is also 180° in this case. Therefore, the cancellation of the signal at the mid-band frequencies is not perfect. The voltage output does not approach zero and a less deep null (zero) is produced, as shown in FIGS. 9A–C. Since the signal cancellation is not perfect, the magnitude of the null can be optimized to a desired magnitude, such as −30dB as shown in FIG. 9A. However, off the mid-band frequency at both lower and higher frequencies the signal cancellation is closer to perfect (i.e., the residue vector is very small) which causes nulls that are deeper than the null at the mid-band, as shown in FIG. 9A. FIG. 9D shows the near perfect cancellation of the null frequency below the mid-band $F_{Lo}$. Correspondingly, FIG. 9E shows the near perfect cancellation of the null frequency above the mid-band $F_{Hi}$. Those skilled in the art will appreciate that the hybrid filter element can be designed to have either equal or unequal power splits by appropriate selection of the impedance transformer and cancellation loop elements to result in the desired perfect cancellation at the mid-band, as shown in FIGS. 8A–E, or to set the magnitude of the null at the mid-band, as shown in FIGS. 9A–E.

Figure 10:
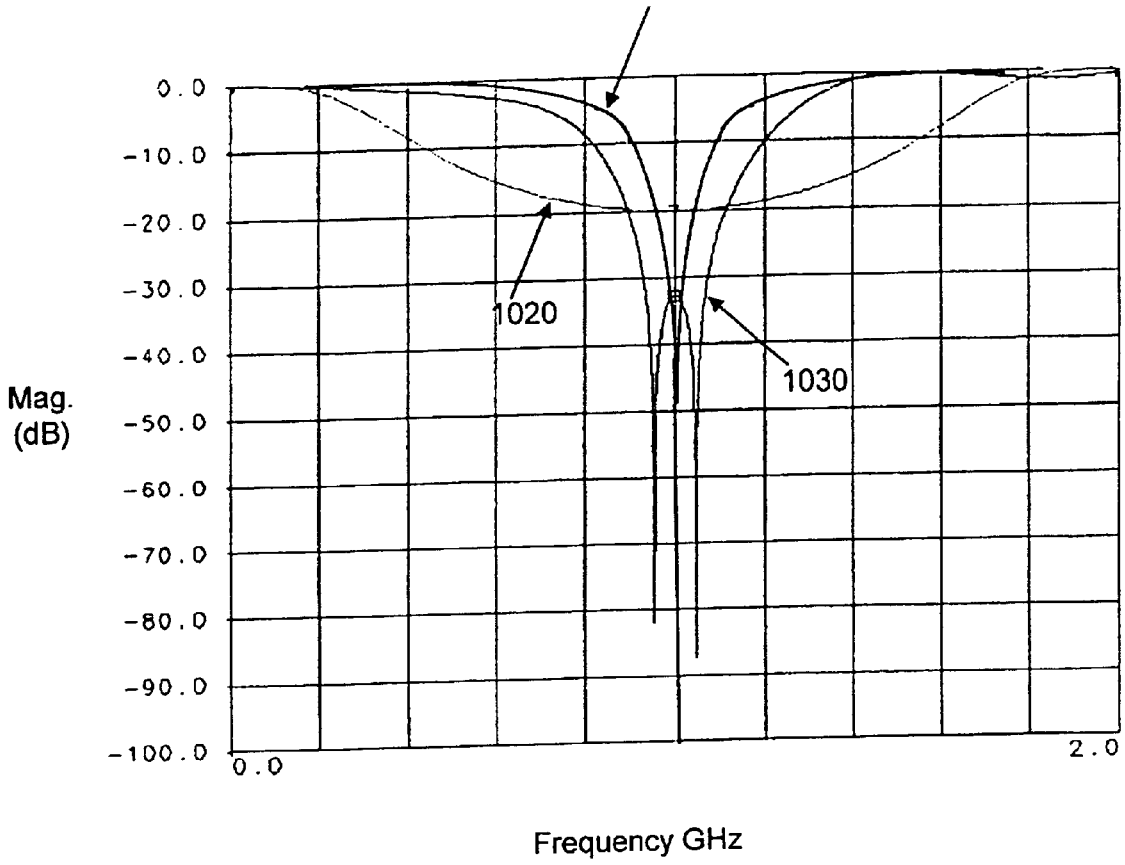
FIG. 10 is a graph comparing the filter response of the present invention, an opened stub design and an impedance transformer design.

FIG. 10 graphically illustrates a comparison of filter responses using the hybrid filter design 1030, opened stub design 1010, and impedance transformer design 1020. As can be seen in FIG. 10, the bandwidth response for the hybrid filter design 1030 is approximately 7.2×the bandwidth of the opened stub design 1010 or approximately 14.4 percent. In addition to the increased bandwidth, the present invention provides a steep roll off, unlike the very gradual roll off of the transformer design 1020.

The hybrid filter according to the present invention is particularly useful when there is a large bandwidth requirement but very limited space available. By creating a phase cancellation loop, two phenomena are accomplished, wide bandwidth and steep roll off. The phase cancellation loop creates a bandwidth that is wider than the typical reactive stub, but not as wide as the impedance transformer. However, the roll off of the hybrid filter is not as gradual as that of the transformer, thus not interfering with the pass band. Another aspect of the phase cancellation loop is the multiple paths of the filter. Additionally, unlike the stub and the transformer designs, there are multiple paths allowing for a closer alignment of the filter. A single hybrid filter has three possible paths (i.e., through the first portion, through the second portion, and split among both the first and second portion) and produces two gain zeros. Each time a hybrid filter is added the number of gain-zero increases by a factor of $n^2+1$, wherein n is the number of hybrid filters. Each gain-zero increases the bandwidth of the filter. For a single hybrid filter, the bandwidth is increased to approximately 7.2×that of a single reactive stub at −30 dB. The reactive stub does have a deeper null than that of the hybrid filter. However, the bandwidth of the stub design is only 2%. Generally, the trade off for the deep null at a mid-band frequency is well worth the increased bandwidth, especially for wide band structures.

The foregoing description described the preferred embodiments of the invention. However, those skilled in the art will appreciate that the invention can be practiced in many alternative embodiments. For example, the hybrid filter element can be made out of any suitable conductive material, such as aluminum, copper, etched circuit boards, silver, gold, and the like. Further, the invention can be designed for any mid-band frequency (e.g., radio or microwave frequencies) as will be appreciated by those skilled in the art. Still further, the shape of the phase cancellation loop is not limited to any particular geometric form and can be adapted to fit within specific physical envelopes. Although the shape of the phase cancellation loop is not limited to a particular form, the electrical length of the structure is designed to yield a 180° phase shift difference at the mid-band frequency between the first and second portions of the phase cancellation loop.

Additionally, the hybrid filter element can be used in any circuit, component, or system that requires nonlinear frequency response, as will be appreciated by those skilled in the art. For example, the hybrid filter element can be used in low-pass, bandpass, notch filter and high-pass filters. As illustrated in FIG. 7A and the frequency response graph 1030 of FIG. 10, a notch filter response occurs between P1 and P2. Additionally, low-pass and high-pass configurations can be achieved by adjusting the pass frequencies (i.e., shifting curve 1030 to the left or the right). Finally, a bandpass configuration can be achieved by grounding a terminal of the hybrid filter element, which would cause the high and low frequencies to shunt to ground and the center frequency to pass. The hybrid filter element can also be used in devices such as diplexers, receivers, transmitters, tuners, oscillators, and the like.

Accordingly, the foregoing detailed description merely illustrates the principles of the invention. It will thus be appreciated that those skilled in the art will be able to devise various arrangements which, although not explicitly described or shown herein, embody the principles of the invention and are thus within its spirit and scope. Therefore, the scope of the invention is not limited by the foregoing description but is defined solely by the appended claims.

What is claimed is:

1. A hybrid filter element, comprising:

an impedance transform; comprises end portions that are located at opposite ends of a first portion and a phase cancellation loop including said first portion and a second portion, wherein said first and second portions are designed to provide a phase difference between said first and second portions of about 180° at a mid-band frequency, and wherein the first portion forms part of the impedance transformer.

2. The hybrid filter element as defined by claim 1, wherein said hybrid filter element is part of a filter.

3. The hybrid filter element as defined by claim 2, wherein said filter is at least one of a low-pass, bandpass, notch filter and high-pass filter.

4. The hybrid filter element as defined by claim 1, wherein said first portion is smaller than said second portion.

5. The hybrid filter element as defined by claim 1, wherein said mid-band frequency is on the order of radio frequencies.

6. The hybrid filter element as defined by claim 1, wherein said mid-band frequency is on the order of microwave frequencies.

7. The hybrid filter element as defined by claim 1, wherein said first portion and said second portion are designed to produce a substantially equal power split of a signal traversing said first and second portions.

8. The hybrid filter element as defined by claim 1, wherein said first portion and said second portion are designed to produce an unequal power split of a signal traversing said first and second portions.

9. The hybrid filter element as defined by claim 8, wherein said first portion is smaller than said second portion and wherein more power of said signal travels through said second portion.

10. The hybrid filter element as defined by claim 1, wherein said first and second portions are formed from a conductive material.

11. The hybrid filter element as defined by claim 10, wherein said conductive material is at least one of aluminum, copper, etched circuit boards, silver, and gold.

12. A hybrid filter element, comprising:

an impedance transformer comprising end portions that are located at opposite ends of a first portion; and a second portion having respective ends connected to the ends of said first portion, wherein said first and second portions are designed to provide a phase difference between said first and second portions of about 180° at a mid-band frequency.

13. A hybrid filter element of claim 12, wherein a length of said first portion is less than a length of said second portion.

14. A hybrid filter element of claim 12, wherein a width of said first portion is less than a width of said second portion.

15. A hybrid filter element of claim 14, wherein a length of said first portion is less than a length of said second portion.

16. The hybrid filter element as defined by claim 12, wherein said first portion and said second portion are designed to produce a substantially equal power split of a signal traversing said first and second portions.

17. The hybrid filter element as defined by claim 12, wherein said first portion and said second portion are designed to produce an unequal power split of a signal traversing said first and second portions.

18. The hybrid filter element as defined by claim 12, wherein said first and second portions are formed from a conductive material.

19. The hybrid filter element as defined by claim 18, wherein said conductive material is at least one of aluminum, copper, etched circuit boards, silver, and gold.

* * * * *